US010832535B1

(12) United States Patent
Capota et al.

(10) Patent No.: US 10,832,535 B1
(45) Date of Patent: Nov. 10, 2020

(54) SLEEPBUDS FOR PARENTS

(71) Applicant: BOSE CORPORATION, Framingham, MA (US)

(72) Inventors: Christine Alexandra Capota, Brookline, MA (US); Rodrigo Alexei Vasquez, Medford, MA (US); Sara Beth Ulius-Sabel, Northborough, MA (US); Jamison Bradley Bourque, Newton, MA (US); Glenn Gomes Casseres, Newton, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/584,352

(22) Filed: Sep. 26, 2019

(51) Int. Cl.

| | |
|---|---|
| ***G08B 21/18*** | (2006.01) |
| ***G08B 3/10*** | (2006.01) |
| ***G08B 29/10*** | (2006.01) |
| ***G08B 17/06*** | (2006.01) |
| ***G08B 21/06*** | (2006.01) |

(52) U.S. Cl.
CPC ..... *G08B 3/10* (2013.01); *G08B 17/06* (2013.01); *G08B 21/06* (2013.01); *G08B 21/182* (2013.01); *G08B 29/10* (2013.01)

(58) Field of Classification Search
None
See application file for complete search history.

(56) References Cited

U.S. PATENT DOCUMENTS

| | | | | |
|---|---|---|---|---|
| 7,659,814 | B2 * | 2/2010 | Chen | G08B 25/08 340/531 |
| 9,167,348 | B1 * | 10/2015 | Vartanian | H04R 1/1041 |
| 9,530,080 | B2 * | 12/2016 | Glazer | H04N 5/2251 |
| 9,579,060 | B1 * | 2/2017 | Lisy | A61B 5/6803 |
| 9,729,989 | B2 * | 8/2017 | Marten | H04R 29/008 |
| 9,906,636 | B2 * | 2/2018 | Lee | H04M 1/6066 |
| 10,447,972 | B2 * | 10/2019 | Patil | G06T 7/246 |
| 10,593,184 | B2 * | 3/2020 | Greene | G06K 9/00718 |
| 2007/0092087 | A1 * | 4/2007 | Bothra | H04M 1/6058 381/74 |
| 2008/0309765 | A1 * | 12/2008 | Dayan | H04N 7/185 348/158 |
| 2011/0313555 | A1 * | 12/2011 | Shoham | G10L 25/48 700/94 |
| 2013/0343584 | A1 * | 12/2013 | Bennett | H04R 25/554 381/315 |
| 2014/0185828 | A1 * | 7/2014 | Helbling | H03G 5/165 381/103 |
| 2014/0371635 | A1 * | 12/2014 | Shinar | A61B 5/6891 600/595 |

(Continued)

*Primary Examiner* — Curtis A Kuntz
*Assistant Examiner* — Muhammad Adnan
(74) *Attorney, Agent, or Firm* — Patterson + Sheridan, LLP

(57) ABSTRACT

Aspects of the present disclosure provide a system for selectively outputting indications of important events of which the user would like to be notified. Based, at least in part, on settings configured via user inputs, the system receives an indication of a detected acoustic event and determines whether the acoustic event corresponds an event in a list of preferences stored in a remote server. In response to determining that the events match, the system then instructs a personal audio output device to output an indication of the detected acoustic event to the user of the personal audio output device.

20 Claims, 4 Drawing Sheets

(56) References Cited

U.S. PATENT DOCUMENTS

| | | | | |
|---|---|---|---|---|
| 2015/0109441 | A1* | 4/2015 | Fujioka | H04N 7/183<br>348/143 |
| 2017/0061760 | A1* | 3/2017 | Lee | A61B 5/11 |
| 2017/0084264 | A1* | 3/2017 | Kuo | H04R 3/002 |
| 2017/0258398 | A1* | 9/2017 | Jackson | A61B 5/4812 |
| 2019/0069839 | A1* | 3/2019 | Park | G16H 10/60 |
| 2019/0090860 | A1* | 3/2019 | Shinar | A61B 10/0012 |
| 2019/0099009 | A1* | 4/2019 | Connor | A61B 5/0205 |
| 2019/0174208 | A1* | 6/2019 | Speicher | H04B 1/385 |
| 2019/0247611 | A1* | 8/2019 | Karp | A47D 15/008 |
| 2019/0343452 | A1* | 11/2019 | Ellspermann | A61B 5/4557 |

* cited by examiner

SLEEPBUDS FOR PARENTS

FIELD

Aspects of the present disclosure provide a system to help protect a user's sleep by outputting masking sounds and selectively notifying the user of specific sounds of importance. In aspects the same or different devices in the system output the masking sound and output an indication of sounds of importance.

In aspects, the system includes multiple people each receiving masking sounds from an audio output device. The system is configured to selectively output sounds of importance to one of the multiple audio output devices in the system, thereby attempting to alert one user while continuing to protect other user's sleep.

BACKGROUND

Sleep disruptions may result in poor sleep which negatively affects a person's health. Environmental or ambient noises can cause sleep disruptions. Sleep assistance devices are used to try to mitigate or block such disruptions by outputting masking sounds; however, some people may avoid the use of sleep assistant devices because they worry about sleeping through sounds of importance. For example, an individual may fear not hearing a crying baby at night or sleeping through a fire alarm.

The use of noise-mitigating or noise-blocking devices may improve the quality and quantity of a person's sleep and, consequently, the person's overall health. A need exists to help people stay and fall asleep as well as allow certain sounds to be heard by the person.

SUMMARY

All examples and features mentioned herein can be combined in any technically possible manner.

Aspects describe a system for selectively outputting detected environmental sounds or alerts notifying a user of detected environmental sounds. In one example, aspects provide an audio output device configured to output noise masking sounds in an effort to help a user fall and stay asleep. The audio output device selectively outputs the real-time detected environmental sounds in an effort to notify the user of a sound of importance. Based, at least in part, on the user's preferences, the system determines when to output at least one of the detected real-time environmental sounds, a version of the detected environmental sound, or an alert in an attempt to notify the user.

In another example, the system includes two audio output devices, a first device used by a first user and a second device used by a second user. The audio output devices may be referred to as personal audio output devices. One or both of the devices are configured to output masking sounds. Further, based, at least in part, on each user's preferences, the system determines whether to output detected real-time environmental sounds, a version of the detected environmental sound, or an alert to neither of the audio output devices, the first audio output device, the second audio output device, or both audio output devices.

Accordingly, aspects describe a system for selectively outputting audio indications of important sounds to a user. As described below, the system includes any combination of audio output devices, audio receiving devices, and the cloud (which may be referred to as a remote server or network server). The system receives user input via a user device which indicates one or more audio events of importance to the user. Any device in the system and/or the cloud maintains a list of preferences for the user based on the one or more events of importance input by the user. Devices in the system monitor and detect acoustic events in the user's environment. A device in the system or the cloud then compares the detected acoustic events with the list of preferences to see if the detected acoustic event corresponds to one of the events of importance. In response to determining that the detected acoustic event corresponds to one of the events of importance, the system (a device in the system or the cloud) instructs one or more audio output devices to output an indication of the detected acoustic event. By outputting the indication of the detected acoustic event, the system selectively notifies the user when an event of importance occurs.

According to aspects, a computer-implemented method for selectively outputting a sound by a first personal audio output device in a system is provided. The method comprises receiving, via a user device in the system, an indication of one or more events of importance to a first user of the first personal audio output device, maintaining a list of preferences for the first user based on the one or more events of importance, receiving, via a second user device in the system, an indication of a detected acoustic event, comparing the detected acoustic event with the list of preferences to determine if the detected acoustic event corresponds to one of the events of importance to the first user, and in response to determining the detected acoustic event corresponds to one of the events of importance to the first user, instructing the first personal audio output device to output an indication of the detected acoustic event to the first user.

In aspects, the method further comprises receiving an indication of one or more events of importance to a second user of a second personal audio output device, wherein the maintaining further comprises maintaining preferences for the second user based on the one or more events of importance to the second user, the comparing further comprises comparing the detected acoustic event with the list of preferences for the second user to determine if the detected acoustic event corresponds to one of the events of importance to the second user, and in response to determining that the detected acoustic event does not correspond to one of the events of importance to the second user, refraining from instructing the second personal audio output device to output an indication of the detected acoustic event to the second user.

In aspects, instructing the first personal audio output device to output the indication of the detected acoustic event to the first user comprises instructing the first personal audio output device to output one of the detected acoustic event or an alert indicating the detected acoustic event.

In aspects, instructing the first personal audio output device to output the detected acoustic event to the first user comprises instructing the first personal audio output device to alter a sound-masking output.

In aspects, the method further comprises receiving, via the user device, one or more of a range of times or days of a week associated with the one or more events of importance. In aspects, the detected acoustic event comprises any sound that exceeds one of a threshold decibel level or duration of time.

In aspects, maintaining the list of preferences for the first user based on the one or more events of importance and comparing the detected acoustic event with the list of preferences to determine if the detected acoustic event corresponds to one of the events of importance to the first user are performed without accessing the Internet.

According to aspects, a method is performed in a system comprising a personal audio output device, a network server, user device, and a portable bedside unit configured to wireless transmit and receive data. The method comprises receiving, from the user device, an indication of one or more events of importance to a user of the personal audio output device, maintaining, by the network server, a list of preferences for the user based on the one or more events of importance, outputting, by the personal audio output device, a masking sound, detecting, by the portable bedside unit, sounds in the system, transmitting, by the portable bedside unit, the sounds to the network server, comparing, by the network server, the detected sounds with the list of preferences to detect one of the events of importance in the sounds, in response to detecting one of the events of importance in the sounds, instructing, via one of the portable bedside unit or the user device, the personal audio output device to output an indication of the detected event of importance to the user, and outputting, by the personal audio output device, the indication of the detected event of importance until the user takes action to stop the indication of the detected event of importance or the detected event of importance has concluded.

In aspects, the method further comprises determining, by the network server, the detected sounds in the system do not include one of the events of importance, refraining from instructing, via one of the portable bedside unit or the user device, the personal audio output device to output the indication of the detected event of importance to the user.

In aspects, the method further comprises continuing to output, by the personal audio output device, the masking sound.

In aspects, an application running on the user device receives information from the user regarding the one or more events of importance.

In aspects, outputting the indication of the detected event of importance comprises outputting one of a preconfigured alert or a version of detected event of importance. In aspects, outputting the version of the detected event of importance comprises increasing a decibel level at which the version of the detected event of importance is output until a threshold decibel level is reached. In aspects, the method further comprises, after the threshold decibel level is reached, outputting the preconfigured alert.

In aspects, the sounds comprise an audio stream received from the portable bedside unit throughout a sleep period.

According to aspects, a method is performed by a network server in a system comprising a first personal audio output device, a second personal audio output device, the network server, a user device, and a portable bedside unit configured to wirelessly transmit and receive data. The method comprises receiving a first set of indications of events of importance to a first user of the first personal audio output device, receiving a second set of indications of events of importance to a second user of the personal audio output device, maintaining a list of preferences for the first user and the second user based on the first and second set of indications, receiving, from the portable bedside unit, a detected audio stream, detecting one of the events of importance in the audio stream, selectively determining which of the first or second personal audio output devices will output an indication of the detected event of importance based, at least in part, on the list of preferences, and instructing one of the first or second personal audio output devices to output an indication of a detected acoustic event based on the determination.

According to aspects, selectively determining which of the first or second personal audio output devices will output the indication of the detected event of importance is based on: determining which of the first user or the second user is in a more fragile state of sleep, and selecting to output the indication to one of the first user or the second user based, at least in part, on which of the first user or the second user is in the more fragile state of sleep.

In aspects, selectively determining which of the first or second personal audio output devices will output the indication of the detected event of importance is based on which of the first or second personal audio output devices is set to an aware mode.

In aspects, detecting one of the events of importance comprises comparing the detected audio stream with the list of preferences to determine the detected audio stream includes a version of one of the events of importance to the first user or the second user.

In aspects, the list of preferences includes one or more of a range of times or days of a week associated with each of the events of importance.

Advantages of a system which outputs masking sounds, detects an occurrence of an event of importance, and selectively instructs one or more audio output devices to output an indication of the detected sounds of importance will be apparent from the description and the claims.

DETAILED DESCRIPTION

An audio sleep assistance or sleep protection device outputs masking sounds to help users fall and stay asleep. Devices that block environmental noises and output masking sounds may help a user sleep; however, a user may be less likely to wake-up in response to sounds (acoustic events) of importance. Currently, some people may avoid use of sleep assistance devices because they fear sleeping through events.

In one example, already exhausted parents may not want to use sleep assistance devices because they worry about not hearing their crying child or signals of distress while they are sleeping.

In another example, baby monitors are used so that a child may sleep in a room separate from the child's parents or caregiver. A receiver in the child's room detects sounds from the child's environment and transmits the sounds to a receiver unit close to the child's caregiver. Sounds of the child moving, breathing, babbling, and the like may unnecessarily disrupt the caregiver's sleep. In some scenarios, both parents or multiple caregivers experience sleep disruption when exposed to the transmitted sounds from the child's sleep environment.

Regardless of the use of a baby monitor, in an example, even when a parent or caregiver should wake up to tend to a child, it is often unnecessary for multiple people to wake up to care for the child. Therefore, when both parents or multiple caregivers are awakened by a noise, at least one of them may be unnecessarily losing sleep or experiencing sleep disruption.

In an effort to increase the adoptability of sleep assistance devices, aspects describe methods, apparatus, and systems for outputting masking sounds, determining real-time environmental sounds of importance, and outputting an indication of any detected sound of importance. The phrase "masking sound" refer to soothing sounds, audio therapeutics, relaxation soundtracks, entrainment soundtracks, and the like. As will be described in more detail herein, in aspects, the system coordinates outputting the indication of any detected sound of importance to a subset of audio output devices in the system. In this manner, the system alerts at least one user of the sound of importance and continues to protect the sleep of another user.

As described herein, sounds of importance include any sound that the user desires to be made aware of, for example, while sleeping. Examples of sounds of importance include fire alarms, home safety alarms, telephone calls from certain people, or any other alarm, alert, or noise deemed to be important to the user. Sounds of importance may be user-specific and user-customized to include sounds the user desires to be made of aware of, such as a baby crying, a child or elderly individual speaking the user's name, a dog whining, or a dog barking. In aspects, the user specifies the day, time period, or combination of day and time period in which the user desires to hear each of the sounds of importance.

Figure 1:
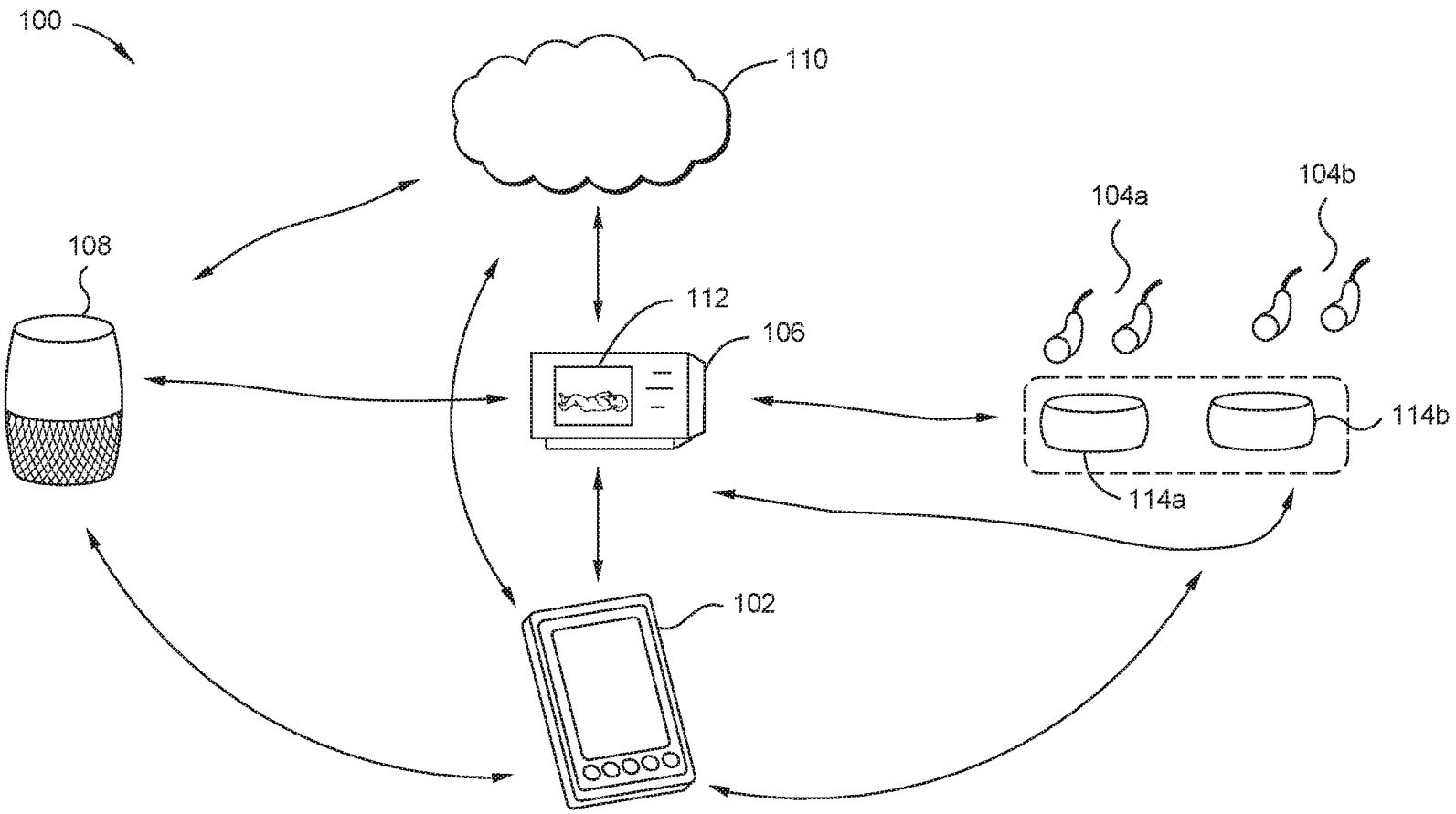
FIG. 1 illustrates an example system for selectively outputting sound to a user.

FIG. 1 illustrates an example system 100 for protecting sleep and selectively notifying at least one user of a sound of importance, according to aspects of the present disclosure. The system 100 selectively outputs indications of sounds of importance which the user would like to be notified.

The system 100 includes an audio output device 104*a*. The audio output device 104*a* outputs masking sounds and allows real-time audio to be piped through to the user. In aspects, the audio output device 104*a* is configured to simultaneously output masking sounds and real-time audio, a version of the real-time audio, or an alert.

While the audio output device 104*a* is illustrated as a pair of in-ear audio sleepbuds, the audio output device may be any personal audio output device. Examples include wearable or non-wearable audio output device such as, for example, over-the-ear headphones, audio sleep mask, audio eyeglasses or frames, around-ear audio devices, open-ear audio devices (such as shoulder-worn or body-worn audio devices), audio wrist watches, speaker, portable bedside unit, or the like.

The audio output device 104*a* includes at least one acoustic transducer (also known as driver or speaker) for outputting sound. The acoustic transducer(s) may be configured to transmit audio through air and/or through bone (e.g., via bone conduction, such as through the bones of the skull). In an aspect, the audio output device includes one or more microphones to detect sound/noise in the vicinity of the device to enable active noise reduction (ANR). In aspects audio output device includes hardware and circuitry including processor(s)/processing system and memory configured to implement one or more sound management capabilities or other capabilities including, but not limited to, noise cancelling circuitry and/or noise masking circuitry and other sound processing circuitry. The noise cancelling circuitry is configured to reduce unwanted ambient sounds external to the audio output device by using active noise cancelling. The sound masking circuitry is configured to reduce distractions by playing masking sounds via the speakers of the audio output device.

In an aspect, the audio output device 104*a* is an Internet-of-Things (IoT) device. The audio output device 104*a* receives data, commands, and audio from a hub 114*a*. The hub 114*a* sends and receives information from other devices in the system 100 and relays instructions to the audio output device 104*a*. As described below, the hub 114*a* receives audio, commands, or data from a monitoring unit 108, bedside unit 106, and/or software interface of a smart device (user device) 102 and transmits instructions to the audio output device 104*a*. In aspects, the audio output device 104*a* includes the processing circuitry of the hub 114*a* and directly communicates with one or more of the other devices in the system 100. In yet other aspects, one or more of the monitoring unit 108, bedside unit 106, and/or software interface of the smart device 102 perform features of the hub 114*a*.

The monitoring unit 108 is a monitoring unit that collects information regarding at least one of audio, video, motion, or the environment from a location that is remote to the audio output device 104*a*. Audio refers to raw data collected from the monitoring unit 108, data filtered based on user-set thresholds such as volume, duration or classification, an alert, or an algorithmic analysis of noises in the environment of the monitoring unit 108. In an example, the monitoring unit 108 is a baby monitoring unit.

In addition to collecting audio, in an example, the monitoring unit 108 collects video and other data from the location remote to the user. In aspects, the monitoring unit 108 is configured to collect biometric information associated with the child such as, for example, a breathing rate, respiration rate, or the child's temperature. In aspects, the monitoring unit 108 is configured to detect movement of the child or characteristics of the room such as temperature, humidity, or carbon monoxide level of the room.

In an example, the monitoring unit 108 is placed in a baby's room and the user of the audio output device 104*a* sleeps in a different room. The monitoring unit 108 engages in bidirectional communication with the bedside unit 106, the cloud 110, and the software interface running on a smart device 102. While aspects describe a monitoring unit 108, the monitoring unit may be any device that collects, at least, audio. In an example, the monitoring unit is a home security system, smart doorbell or doorbell camera, a smart home integration system, or any system that outputs push notifications.

The bedside unit 106 is a portable unit that is configured to receive audio from the monitoring unit 108. In addition to receiving audio, in an example, the bedside unit 106 is configured to receive video and/or other data from the monitoring unit 108, the cloud 110, and/or software interface running on the smart device 102. The bedside unit engages in bidirectional communication with the monitoring unit 108, the cloud 110, software interface running on the smart device 102, and hub 114*a*. In aspects, the system 100 does not include a hub 114*a* for the audio output device 104. Instead, the bedside unit 106 performs the functions of the hub 114*a*. In aspects, the bedside unit 106 includes a screen 112 for outputting a video stream transmitted from another device in the system, such as the monitoring unit 108. In aspects, as describe below, the screen 112 provides a user interface for the user to enter preferences regarding acoustic events of importance and associated days and times for each acoustic event.

The smart device 102*a* uses a software interface to provide a user interface (via an application). The smart device 102 engages in bidirectional communication with the bedside unit 106, monitoring unit 108, the cloud 110, and hub 114*a*.

The user interface enables the user to input user preferences regarding sounds of importance to the specific user. The user may record real-time sounds and upload them to the application, such as the user's child speaking "mom" or "dad" and identify the sounds as sounds of importance. Additionally or alternatively, the user may select preconfigured or provided sounds as sounds of importance, such as a generic baby crying sound clip.

Using the application, the user specifies when he or she would like to be made aware of the identified sounds of importance. In an example, the sounds of importance may be any sound that exceeds a configurable decibel value or exhibits certain tonal qualities for a configurable amount of time. In an example, the user desires to be notified of sounds of importance whenever the application is in an "aware" state (as opposed to an "off" or "sleep" state). In this example, the user may set the audio output device 104*a* to an aware mode, using the user interface of the smart device 102 (or of any other device in the system 100), before going to sleep to indicate to the system that the user would like to be made aware of acoustic events of importance in accordance with the user's preferences.

In another example, the user may not have nighttime caregiving responsibilities on certain days of the week or may have a partner assume caregiving responsibilities at some point during the user's sleep period. The user may input a schedule including days of the week or hours during a sleep period for each day that he or she would like to be notified of the identified sounds of importance. In aspects, the sounds the user would like to be made aware of vary based on the day of the week or time of day.

As an example, the user may identify a crying baby as a sound of importance if detected on Monday-Friday beginning from 10 PM to 5 AM the following day and Saturday-Sunday from 10 PM to 8 AM the following day, and identify a puppy whining as a sound of importance seven days a week if detected between 1 AM to 5 AM. The application allows the user to enter preferences for the combination of day, time, and sounds of importance.

In an example, the user may set a mode for both the user's personal audio output device and also for the personal audio output device of another user in the system. The ability for a user to set modes for both personal audio output devices 104*a* and 104*b* facilitate handoff during a sleep period. For example, when a second user assumes night-time care giving responsibilities, the second user may set the first user's mode to an "off" or "sleep" state and set the second user's mode to an "aware" state. This may help ensure that at least one of multiple personal audio output devices in the system 100 are set to an "aware" state, especially during transitions from one primary caregiver to another. In aspects, the application allows the user to enter preferences regarding any combination of day, time, and sounds of importance for not only the user but also for another user of the system 100. For example, the application enables the user to enter preferences for the user of personal audio output devices 104*a* and 104*b*.

In aspects, the software interface is run on the bedside unit 106, thereby eliminating the need for the smart device 102. In an aspect, a user interface is provided on both the smart device 102 and the bedside unit 106. The user interface running on the bedside unit may offer fewer customization features as compared to the user interface running on the smart device 102. In an aspect, the user has the option to set the application to an "aware" mode or a "sleep" or "off" mode on both the smart device 102 and the bedside unit 106. Providing, at least, some user input options on the bedside unit 106 helps to reduce the need for a user to look at a bright screen of the smart device 102 before going to sleep.

The cloud 110 refers to a cloud/remote/network server where applications and data are maintained and made available using the Internet. The user's preferences input using the software interface can be stored on the cloud 110.

In an example, the user input received via the software interface is transmitted by the smart device 102 to the cloud 110. The cloud 110 maintains the user's preferences. In another example, the smart device 102 provides one of the monitoring unit 108 or bedside unit 106 with the preferences input by the user, and the monitoring unit 108 or bedside unit 106 provides the cloud 110 with the user's preferences. Based on the user's preferences and real-time sounds collected by the monitoring unit 108, the cloud 110 determines when sounds of importance are occurring and when to output indications to alert the user of such sounds Because the devices in the system 100 communicate with each other and in turn the cloud 110, the user's preferences and any instructions to output an indication of a detected sound of importance may be relayed between devices and the cloud before arriving at the intended location or device in the system 100.

In an example, the cloud 110 supports artificial intelligence (AI)-based capabilities. The AI-based capabilities help identify sounds of importance in the user's environment that may be similar to sounds of importance identified by the user. In aspects, the AI-based capabilities help determine which of multiple users to alert in response to a detected sound of importance based on historical data and/or the type of detected sound.

In an aspect, the system 100 does not include the cloud 110. When the cloud 110 is not accessed, the operations are performed off-line or on a local network. One or more of the bedside unit 106 or monitoring unit 108 maintain user preferences and process data to identify sounds of importance. In an example, the bedside unit 106 or the monitoring unit 108 have a computer chip programmed to cause the bedside unit 106, monitoring unit 108, or combination of bedside unit 106 and monitoring unit 108 to performing the actions for protecting a user's sleep by outputting masking sounds and selectively notifying the user of specific sounds of importance as described herein.

Figure 2:
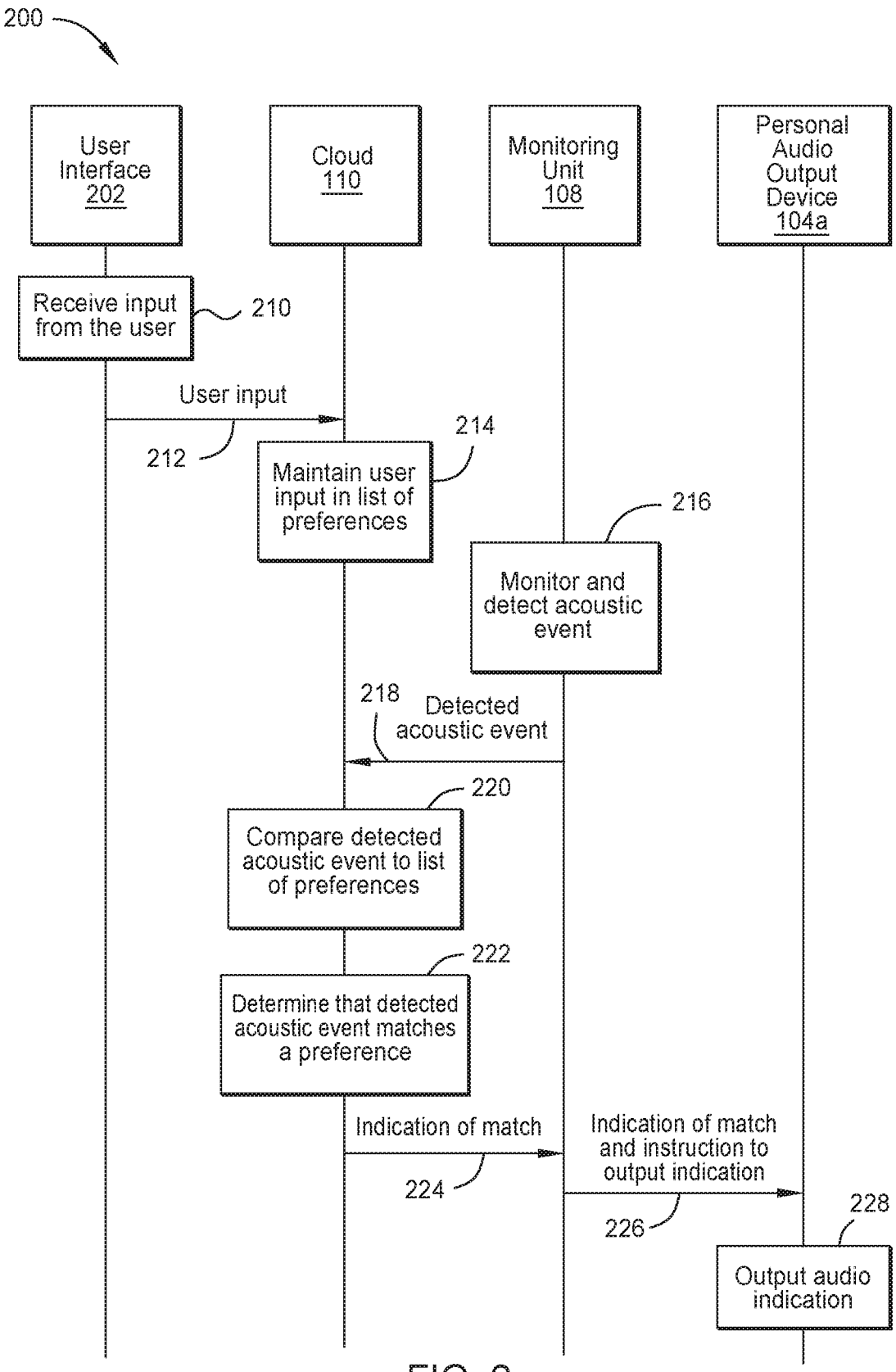
FIGS. 2 and 3 illustrate example operations performed by a system for selectively outputting an indication of a detected acoustic events of importance to a user.

FIG. 2 is a call flow diagram illustrating example operations 200 and signaling for an example system, in accordance with aspects of the present disclosure. At 210, a user interface 202 receives input from a user. In an example, the user interface may be provided by the smart device 102, bedside unit 106, or monitoring unit 108. In an example, the user interface is provided using the screen 112 on the bedside unit 106.

The user input 210 indicates acoustic events of importance to the user. In aspects, the user selects configurable preferences indicating which types of acoustic events are important to the user. The selections may be made using a user interface. Additionally or alternatively, in some examples, a sound of importance is defined as any detected sound that exceeds a user-set threshold decibel level for user-set threshold duration of time. In some examples, a sound of importance is defined as any detected sound that exhibits certain tonal qualities for a threshold period of time. The sounds of importance may be recorded, uploaded to the user device, and sent to the cloud 110.

At 212, the device including the user interface 202 transmits the user's input to a remote server in the cloud 110. At 214, the remote server stores the user's input in a list of preferences or profile assigned to the user. In aspects, an AI algorithm determines sounds of importance based on a user's profile or answers to questions regarding the types of noises and the user's sleeping environment.

At 216, a monitoring unit 108 monitors and detects acoustic events. In aspects, the monitoring unit 108 monitors biometric parameters associated with an individual in the room and characteristics of the room. At 218, the monitoring unit 108 transmits an indication of a detected acoustic event to the cloud 110.

At 220, the cloud 110 compares the detected acoustic event to the stored list of preferences that were received by the cloud 110 at step 212. In aspects, the comparison involves classifying and analyzing the event in an effort to determine if a detected acoustic event 218 corresponds to an acoustic event of importance. At 222, based on the comparison, the cloud 110 determines whether the detected acoustic event matches one or more of the preferences in the list of preferences indicating the acoustic event is of importance to the user.

In response to determining that the acoustic event matches one or more of the user's acoustic events of importance, the system instructs the audio output device 104*a* to output an indication of the detected acoustic event in an effort to alert the user. In aspects, matching includes AI for detecting, classifying, and analyzing sounds, such as the AI for detecting, classifying, and analyzing a baby cry. As illustrated in FIG. 2, at 224, the cloud 110 transmits an indication of the match to the monitoring unit 108. At 226, the monitoring unit 108 instructs the audio output device 104*a* to reduce or stop transmitting a masking sound, and instead output an indication of the detected acoustic event. At 228, the audio output device 104*a* outputs an audio indication of the acoustic event.

In aspects, at 224, the cloud 110 instructs the bedside unit 106, which instructs the hub 114*a* to instruct the audio output device to reduce or stop transmitting a masking sound, and instead output an audio indication of the detected acoustic event.

In an example, the audio indication of the detected acoustic event comprises outputting a version of the detected sound of importance and/or increasing the decibel level at which the version of the detected sound of importance is output until a threshold decibel level is reached. In an example, once the audio indication reaches the threshold decibel level, the audio output device 104*a* is configured to output a preconfigured alert or alarm. In another example, audio output device 104*a* is configured to output the alert after a threshold amount of time has passed without the user taking action to address the sound of importance or manually turn off or silence the audio output device 104*a*. The alert may be a chime, bell, or other sound that attempts to disrupt the user's sleep.

In aspects, the example operations 200 are performed iteratively to notify the user each time the system detects an event of importance.

Referring to FIG. 1, in aspects, the system includes a second audio output device 104*b* and associated hub 114*b*. The audio output device 104*b* and hub 114*b* are similar to the audio output device 104*a* and hub 114*a*. A first user wears the audio output device 104*a* and a second user wears the audio output device 104*b*. The first and second users may sleep in the same room. Each of the first user and the second users may input user preferences using a user interface on the same or separate smart devices. In an aspect, each user has a separate profile and enters his or her user preferences using a smart device or any other device in the system 100. The users may share some common sounds of importance and may identify some sounds of importance unique to the user. As described above, each user inputs sounds of importance in combination with associated days and times in which the user desires to be made aware of a sound of importance if detected. The cloud 110 stores both users' preferences. When a sound of importance is detected, the cloud 110 refers to the stored preferences and determines which of the audio output devices 104*a* and/or 104*b* should output an indication of the detected event. In this manner, based on the user preferences, one user may receive an indication of a detected acoustic event while another user's sleep is protected.

In an example, one or more sensors on the audio output devices 104*a*, 104*b* collect biometric information associated with the users. The sensors collect information such as the user's sleep fragility or how long the user has been asleep. Based on the collected information, the cloud 110 determines which audio output device should pipe an indication of a detected acoustic event. For example, if a first user is in a fragile sleep state and a second user is in deep sleep, an acoustic event of importance to both users may be transmitted to the first user. In another example, if a first user has been sleeping for 8 hours and his alarm is about to ring in 30 minutes and a second user has been sleeping for 3 hours and her alarm is going to ring in 3 hours, an acoustic event of importance to both users may be transmitted to the first user only.

Figure 3:
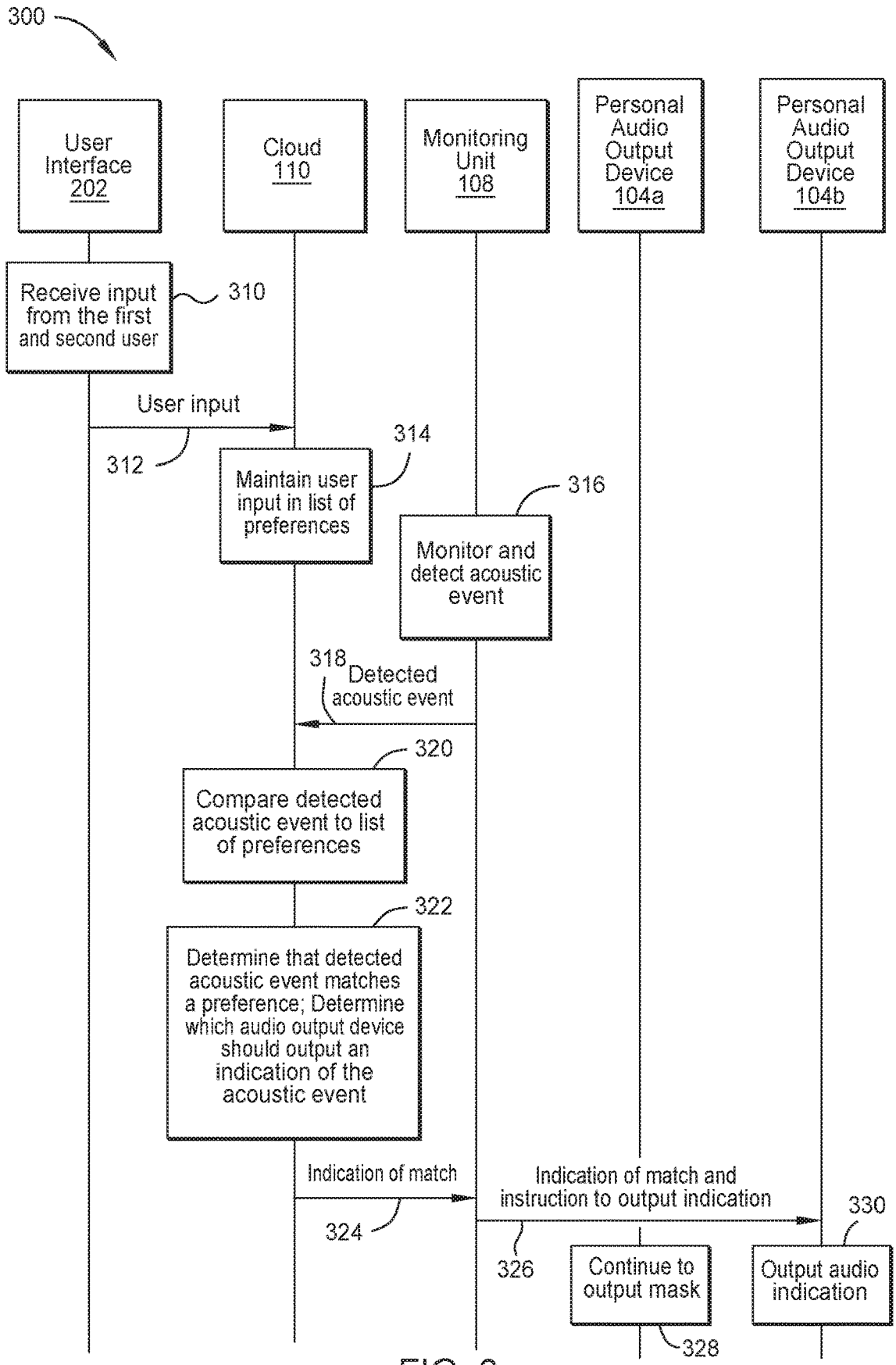

FIG. 3 illustrates example operations 300, in accordance with aspects of the present disclosure. In FIG. 3, the audio output device 104*a* is used by the first user and the audio output device 104*b* is used by a second user in a same sleeping environment.

At 310, at least one user interface 202 receives input regarding acoustic events of importance to each of a first and second user. In aspects, a first user interface receives input from a first user and second interface receives input from a second user. In an example, each of the user interfaces may be provided by any combination of the smart device 102, bedside unit 106, or monitoring unit 108.

At 312, the device(s), including the user interface, transmit each user's input to a remote server in the cloud 110. At 314, the cloud stores each user's input in a list of preferences for that specific user.

At 316, a monitoring unit 108 monitors and detects acoustic events. In an example, the monitoring unit 108 detects one or more acoustic events and transmits an indication of the detected acoustic events to cloud 110. In an example, the monitoring unit 108 directly communicates with the cloud 110. Additionally or alternatively, the monitoring unit 108 communicates with the cloud via another device in the system 100, such as the smart device 102 or the bedside unit 106.

At 320, the cloud 110 compares the detected acoustic events to the stored list of preferences. At 322, the cloud 110 determines whether the acoustic event matches one or more of the preferences in the list of preferences provided by the users. If there is match, the cloud 110 determines which audio output device 104*a*, 104*b* should output an indication of the detected acoustic event.

Next, the cloud 110 instructs one or both audio output devices based on the determination of step 322. The instructions may be transmitted directly or indirectly from the cloud 110 to the audio output device that will provide an indication of the acoustic event. In one example, at 324, in response to determining that an acoustic event matches one or more of the stored preferences and determining which audio output device should output an indication of the acoustic event, the cloud 110 transmits an indication of the match to the audio output device via the monitoring unit 108. The indication from cloud 110 instructs monitoring unit 108 to instruct one or both of the audio output devices 104*a*, 104*b* to reduce, stop, or alter a masking sound, and output an indication of the acoustic event based on the user's preferences.

In aspects, instead of transmitting an indication of the match to the monitoring unit 108 as shown at 324, the cloud 110 transmits an indication to any device in the system 100, such as the smart device 102 or bedside unit 106. In aspects, any of the devices in the system 100 instruct one or both of the audio output devices 104*a*, 104*b* to reduce, stop, or alter a spectral density of a masking sound, and output an indication of the acoustic event.

Altering the masking sound includes changing the volume or content of the masking sounds. In an aspect, masking is reduced to help a user hear the acoustic event. In another example, masking sounds drop off so no sounds are output by the user's audio output device to help the user hear the acoustic event. Correspondingly, the masking sounds are altered to protect the sleep of a user who did not identify the acoustic event as a sound of importance.

Referring back to FIG. 3, assuming, at 322, the cloud determined that an indication of the acoustic event should be transmitted to the second user, the monitoring unit 108 (or any other device in the system 100) transmits instructions 326 to the audio output device 104*b* to output an indication of the event to the second user. Accordingly, at 328, the audio output device 104*a* continues to output a masking sound to the first user and at 330 the audio output device 104*b* outputs an audio indication of the detected acoustic event to the second user. In aspects, the audio output device 104*b* alters or stops masking noises when outputting the indication.

In aspects, the cloud 110 or a device in the system 100 may determine which audio output device 104*a*, 104*b* should output an indication of a detected acoustic event. For example, the cloud 110 or device in the system 100 may determine that a user is more capable of addressing the event of importance because the user is in a lighter sleep stage or has routinely addressed a similar acoustic event over the past several nights. In an example, a breastfeeding caregiver may be alerted of a crying baby if the baby has not been fed for a configurable number of hours. The cloud 110 or device in the system 100 may instruct one of the audio output devices 104*a*, 104*b* based on this determination or similar determinations made based on historical data and/or a learning algorithm.

In another example, the cloud 110 or devices in the system 100 make the determination based on which of the audio output devices 104*a*, 104*b* most recently outputted an indication of an event of importance. For example, if audio output device 104*a* received the most recent instruction to output an indication, the audio output device 104*b* may receive the instruction to output an indication for the next detected acoustic event identified as important by both users.

FIGS. 1-3 provide example use cases for illustrative purposes only. Any of the devices illustrated in FIG. 1 may communicate with any other device or the cloud. Further, not all of the devices or the cloud illustrated in FIG. 1 are necessary to practice the methods described herein. The following example scenarios provide additional use cases for protecting a user's sleep by outputting masking sounds and alerting a user of a sound of importance based on user preferences.

In an example scenario, the bedside unit 106 in the user's room broadcasts out-loud audio. The user of the audio output device 104*a* receives an indication of a detected sound of importance when the audio output device 104*a* reduces or stops outputting masking sounds and outputs an indication of the detected sound of importance. In aspects, in addition the audio output device 104*a* reducing or stopping a masking sound, the audio output device 104*a* outputs an indication of the detected sound. Additionally or alternative, in aspects the bedside unit 106 broadcasts an indication of the detected sound of importance. In an example implementation, settings for both the bedside unit 106 and the audio output device 104*a* are made from the software interface of the smart device 102. When a sound is transmitted from the monitoring unit 108 to at least one of the bedside unit 106, cloud 110, or software interface, software from the bedside unit 106, cloud, or software interface transmits a signal so that the audio, version of the audio, or alert is output by the audio output device 104*a* and the bedside unit 106. The bedside unit 106 outputting an indication of a sound of importance may help to notify a heavy sleeper of the sound of importance.

In an example scenario, when a sound is transmitted from the monitoring unit 108 to the bedside unit 106, cloud 110, or software interface, software from the bedside unit 106, cloud 110 or software interface transmits a signal so that the masking noises output by the audio output device 104*a* dynamically compensate for the out-loud audio broadcast from the bedside unit 106. The masking noises may decrease in volume or change in spectral content so that the out-loud audio output by the bedside unit 106 is more easily heard by the user. In this example, the hub 114*a* may be built into the bedside unit 106 or may be a separate device.

In an example scenario, the system 100 does not include a monitoring unit 108. Instead, a microphone in the bedside unit 106 detects sounds. The bedside unit 106 transmits data to the software interface and/or cloud 110 to determine when a sound of importance occurs. The volume and/or spectral content of the masking sounds output by the audio output device 104*a* are dynamically adjusted to allow the user to hear the sound of importance. Additionally or alternatively, the software interface transmits a signal so that the sound of importance, version of the sound of importance, or alert is transmitted by the audio output device 104*a*. In this example, the hub 114*a* is built into the bedside unit 106. An example use case of this scenario is a baby sleeping in the same room as the parent and the bedside unit 106.

In an example scenario, the system 100 does not include a bedside unit 106. Instead, audio is transmitted from the monitoring unit 108 to the hub 114*a*, cloud 110, and/or software interface. Software from the monitoring unit 108, hub 114*a*, and/or software interface sends a signal so that the audio, version of the audio, or an alert is transmitted by the audio output device 104*a* when a sound of importance is detected. Otherwise, the audio output device 104*a* continues to output masking sounds. Because there is no bedside unit 106 in this scenario, the user may not have the option of a broadcast, out-loud alert of an identifying a sound of importance.

In another example in which the system 100 does not include a bedside unit 106, the hub 114*a* receives data from the monitoring unit 108. When sound is transmitted from the monitoring unit 108 to the hub 114*a*, cloud 110, or software interface, a signal is transmitted so that the audio and/or dynamic masking is transmitted to the audio output device 104*a*. As described above, the settings can be made by the user using the software interface of the smart device 102.

In an example, the system 100 does not include the cloud 110. AI-based capabilities are performed off-line, without connecting to the Internet, by any unit in the system 100, such as the bedside unit 106 or monitoring unit 108.

Figure 4:
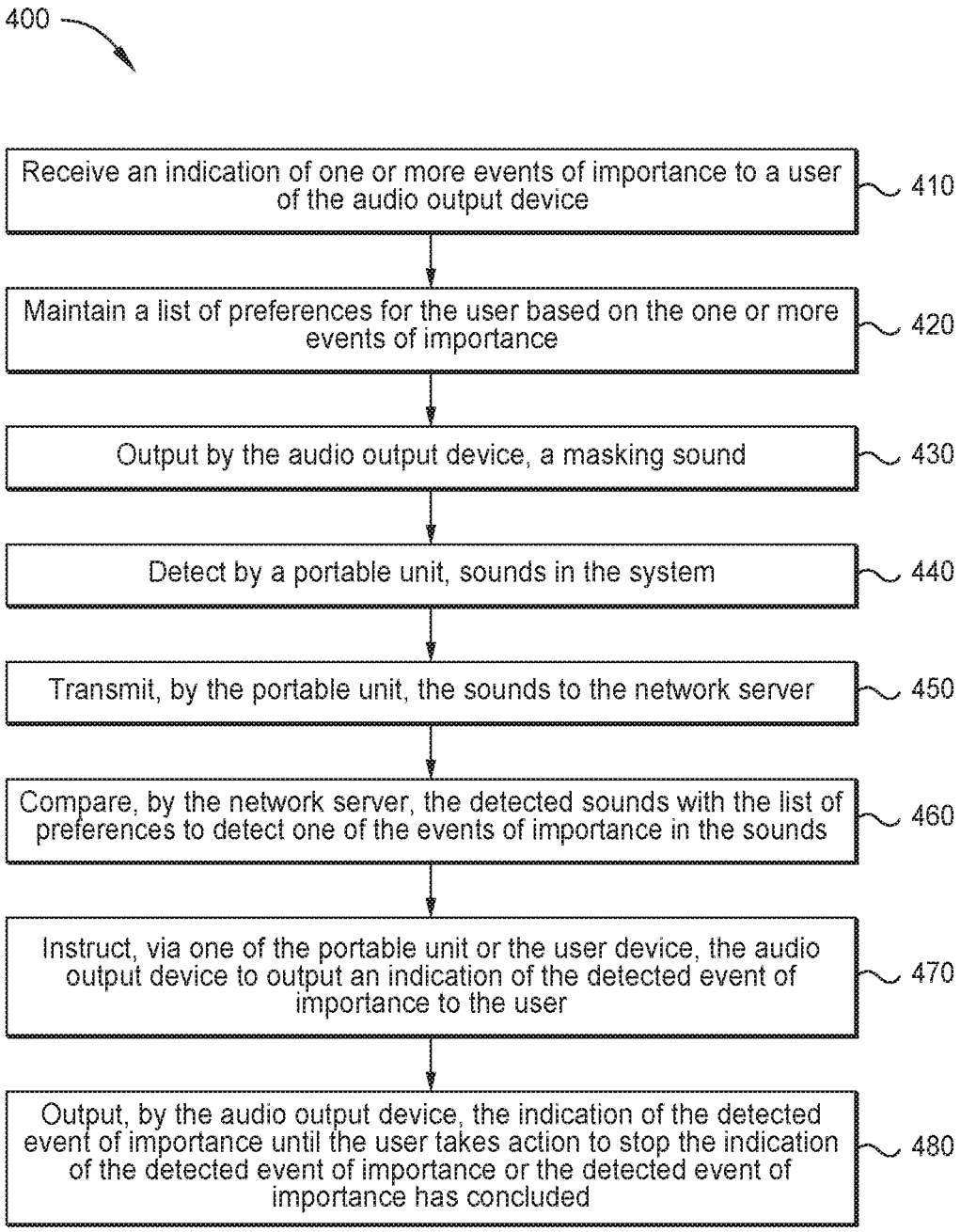
FIG. 4 illustrates example operations performed in accordance with aspects described herein.

FIG. 4 illustrates a flow diagram illustrating example operations 400 for selectively outputting indications of sounds of importance, in accordance with certain aspects of the present disclosure. The operations 400 may be performed, for example, by a system comprising an audio output device, a cloud, a user device, and one or more monitoring units. Operations 400 may be implemented as software components that are executed and run on one or more processors.

At 410, the system receives user preferences of a user. In aspects, the first user's preferences are input by the user using the user device 102 or any other device in the system 100. The preferences include one or more events of importance to the user and associated range of times or days of a week. According to certain aspects, the one or more events of importance comprise events selected from a user interface.

At 420, the system maintains a list of preferences for the user based on the one or more events of importance. In aspects the cloud maintains the user's preferences. At 430, a device in the system outputs a masking sound. In aspects, the device is the audio output device 104*a*. At 440, the system detects sounds in the system. In an aspect, a portable monitoring unit, such as a bedside unit 106 or a monitoring unit 108 detects sounds in the system. At 450, the portable monitoring unit transmits the detected sounds to the cloud.

At 460, the cloud compares the detected sounds with the list of preferences to determine if an event of importance is detected in the sound stream. In aspects the detected sound may not match an event of importance exactly. Instead, the detected sound is a version of one of the events of importance because it shares acoustic properties with an event identified as important by the user. In an example, the user may identify a crying baby as a sound of importance. Sounds of a whining baby may be a version of the crying baby. Therefore, the system alerts the user of a whining baby as well as a crying baby.

At 470, in response to detecting one of the events of importance in the sounds, the system instructs the audio output device to output an indication of the detected event of importance to the user. In aspects, the instructions are transmitted from the cloud to one of the bedside unit or the user device.

At 480, the audio output device outputs an indication of the detected event of importance. In aspects, the indication of the detected event of importance includes one of a preconfigured alert or a version of detected event of importance. To help alert a heavy sleeper, a decibel level of the version of the detected event of importance increases until a threshold level is reached. When the threshold level is reached, if the user has not addressed the event of importance or turned off the audio output device, a preconfigured alert is output by the audio output device or another device in the system in an effort wake the user. In aspects, when the threshold level is reached, the system notifies the second user in an effort to alert somebody of the event.

In aspects, the indication of the audio output device is output until the user takes action to stop the indication of the detected event of importance or the detected event of importance has ended.

In aspects, when the cloud determines that the detected sounds in the system do not include one of the events of importance, the cloud refrains from instructing the audio output device to output the indication of the detected event of importance to the user. Accordingly, the audio output device continues to output a masking sound.

In aspects, the system further receives a set of indications of events of importance to a second user of the second audio output device. The cloud also maintains the second user's preferences. A portable monitoring unit detects an audio stream and the system selectively determines which of the first or second audio output devices will output an indication of the detected event of importance based, at least in part, on the list of preferences. The cloud instructs the selected audio output device to output an indication of the detected acoustic event based on the determination.

In aspects, an acoustic event is important to both users or exhibits acoustic characteristics of an event that merits alerting a user. In an effort to alert one and not all users in the system, the cloud may use inputs to intelligently determine which user to alert. For example, based on monitored biometric parameters, the cloud determines which of the first user or the second user is in a more fragile state of sleep and outputs the indication to the user determined to be in a more fragile state of sleep. In another example, the cloud determines to output the indication to whichever audio output device is set to an aware mode.

Aspects describe methods and system to protect sleep of one or more users while attempting to alert a subset of users of events of importance. By selectively choosing (1) sounds of importance and (2) to whom detected sounds of importance are output, sleeping partners may achieve more restful sleep. Regardless of the partner made aware of an event of importance, the system may filter out non-distress sounds or sounds not identified to be important. In addition to these sounds not being transmitted to the user, a child may self-sooth and fall back asleep. In this manner, the overall sleep quality of the sleeping partners and the child improve over time.

In the preceding, reference is made to aspects presented in this disclosure. However, the scope of the present disclosure is not limited to specific described aspects. Aspects of the present disclosure may take the form of an entirely hardware embodiment, an entirely software embodiment (including firmware, resident software, micro-code, etc.) or an embodiment combining software and hardware aspects that may all generally be referred to herein as a "component," "circuit," "module" or "system." Furthermore, aspects of the present disclosure may take the form of a computer program product embodied in one or more computer readable medium(s) having computer readable program code embodied thereon.

The flowchart and block diagrams in the Figures illustrate the architecture, functionality and operation of possible implementations of systems, methods and computer program products according to various aspects. In this regard, each block in the flowchart or block diagrams may represent a module, segment or portion of code, which comprises one or more executable instructions for implementing the specified logical function(s). In some implementations, the functions noted in the block may occur out of the order noted in the figures. For example, two blocks shown in succession may, in fact, be executed substantially concurrently, or the blocks may sometimes be executed in the reverse order, depending upon the functionality involved. Each block of the block diagrams and/or flowchart illustrations, and combinations of blocks in the block diagrams and/or flowchart illustrations can be implemented by special-purpose hardware-based systems that perform the specified functions or acts, or combinations of special purpose hardware and computer instructions.

The invention claimed is:

1. A computer-implemented method for selectively outputting a sound by a first personal audio output device or a second personal audio output device in a system, comprising:

receiving, via a user device in the system, an indication of one or more events of importance to a first user of the first personal audio output device;

receiving, via the user device in the system, a second indication of one or more events of importance to a second user of the second personal audio output device;

maintaining a list of preferences for the first user and the second user based on the one or more events of importance to the first user or the second user;

receiving, via a second user device in the system, an indication of a detected acoustic event;

comparing the detected acoustic event with the list of preferences to determine if the detected acoustic event corresponds to one of the events of importance to the first user or the second user;

selectively determining which of the first or the second personal audio output devices will output an indication of the detected acoustic event based, at least in part, on the list of preferences; and in response to determining the detected acoustic event corresponds to one of the events of importance to the first user or the second user, instructing one of the first or the second personal audio output devices to output an indication of the detected acoustic event based on the determination.

2. The computer-implemented method of claim 1, further comprising:

in response to determining that the detected acoustic event does not correspond to one of the events of importance to the second user, refraining from instructing the second personal audio output device to output an indication of the detected acoustic event to the second user.

3. The computer-implemented method of claim 1, wherein instructing one of the first or the second personal audio output devices to output the indication of the detected acoustic event comprises:

instructing the first or the second personal audio output device to output one of the detected acoustic event or an alert indicating the detected acoustic event.

4. The computer-implemented method of claim 1, wherein instructing one of the first or the second personal audio output devices to output the detected acoustic event comprises:

instructing the first or the second personal audio output device to alter a sound-masking output.

5. The computer-implemented method of claim 1, further comprising:

receiving, via the user device, one or more of a range of times or days of a week associated with the one or more events of importance.

6. The computer-implemented method of claim 1, wherein the detected acoustic event comprises any sound that exceeds one of a threshold decibel level or duration of time.

7. The computer-implemented method of claim 1, wherein the maintaining the list of preferences for the first user and the second user based on the one or more events of importance and comparing the detected acoustic event with the list of preferences to determine if the detected acoustic event corresponds to one of the events of importance to the first user or the second user are performed without accessing the Internet.

8. A method performed in a system comprising a first personal audio output device, a second personal audio output device, a network server, user device, and a portable bedside unit configured to wirelessly transmit and receive data, comprising:

receiving, from the user device, an indication of one or more events of importance to a first user of the first personal audio output device;

receiving, from the user device, an indication of one or more events of importance to a second user of the second personal audio output device;

maintaining, by the network server, a list of preferences for the first user and the second user based on the one or more events of importance to the first user or the second user;

outputting, by the first and the second personal audio output devices, a masking sound;

detecting, by the portable bedside unit, sounds in the system;

transmitting, by the portable bedside unit, the sounds to the network server;

comparing, by the network server, the detected sounds with the list of preferences to detect one of the events of importance in the sounds;

selectively determining which of the first or the second personal audio output devices will output an indication of the detected event of importance based, at least in part, on the list of preferences;

in response to detecting one of the events of importance in the sounds, instructing, via one of the portable bedside unit or the user device, one of the first or the second personal audio output devices to output an indication of the detected event of importance to the user; and outputting, by the one of the first or the second personal audio output devices, the indication of the detected event of importance until at least one of the first or the second user takes action to stop the indication of the detected event of importance or the detected event of importance has concluded.

9. The method of claim 8, further comprising:

determining, by the network server, the detected sounds in the system do not include one of the events of importance, refraining from instructing, via one of the portable bedside unit or the user device, the first and the second personal audio output devices to output the indication of the detected event of importance to the user.

10. The method of claim 9, further comprising:

continuing to output, by the first and the second personal audio output devices, the masking sound.

11. The method of claim 8, wherein an application running on the user device receives information from the first and the second users regarding the one or more events of importance.

12. The method of claim 8, wherein outputting the indication of the detected event of importance comprises:

outputting one of a preconfigured alert or a version of detected event of importance.

13. The method of claim 12, wherein outputting the version of the detected event of importance comprises increasing a decibel level at which the version of the detected event of importance is output until a threshold decibel level is reached.

14. The method of claim 13, further comprising:

after the threshold decibel level is reached, outputting the preconfigured alert.

15. The method of claim 8, wherein the sounds comprise an audio stream received from the portable bedside unit throughout a sleep period.

16. A method performed by a network server in a system comprising a first personal audio output device, a second personal audio output device, the network server, a user device, and a portable bedside unit configured to wirelessly transmit and receive data comprising:

receiving a first set of indications of events of importance to a first user of the first personal audio output device;

receiving a second set of indications of events of importance to a second user of the second personal audio output device;

maintaining a list of preferences for the first user and the second user based on the first and the second set of indications;

receiving, from the portable bedside unit, a detected audio stream;

detecting one of the events of importance in the audio stream;

selectively determining which of the first or the second personal audio output devices will output an indication of the detected event of importance based, at least in part, on the list of preferences; and instructing one of the first or the second personal audio output devices to output an indication of the detected event of importance based on the determination.

17. The method of claim 16, wherein selectively determining which of the first or the second personal audio output devices will output the indication of the detected event of importance is based on:

determining which of the first user or the second user is in a more fragile state of sleep; and selecting to output the indication to one of the first user or the second user based, at least in part, on which of the first user or the second user is in the more fragile state of sleep.

18. The method of claim 16, wherein selectively determining which of the first or the second personal audio output devices will output the indication of the detected event of importance is based on which of the first or the second personal audio output devices is set to an aware mode.

19. The method of claim 16, wherein detecting one of the events of importance comprises:

comparing the detected audio stream with the list of preferences to determine the detected audio stream includes a version of one of the events of importance to the first user or the second user.

20. The method of claim 16, wherein the list of preferences includes one or more of a range of times or days of a week associated with each of the events of importance.

* * * * *